US011412796B2

(12) United States Patent
Fromer et al.

(10) Patent No.: US 11,412,796 B2
(45) **Date of Patent: *Aug. 16, 2022**

(54) GARMENT WITH WIPE ZONES

(71) Applicant: NIKE, Inc., Beaverton, OR (US)

(72) Inventors: Jacob A. Fromer, Portland, OR (US); Amir H. Morgan, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 256 days.

This patent is subject to a terminal disclaimer.

(21) Appl. No.: 15/810,423

(22) Filed: Nov. 13, 2017

(65) Prior Publication Data

US 2018/0132545 A1 May 17, 2018

Related U.S. Application Data

(60) Provisional application No. 62/423,011, filed on Nov. 16, 2016.

(51) Int. Cl.
*A41B 1/08* (2006.01)
*A41D 31/18* (2019.01)
(Continued)

(52) U.S. Cl.
CPC ..... *A41D 31/18* (2019.02); *A41B 1/08* (2013.01); *A41D 1/04* (2013.01); *A41D 1/08* (2013.01);
(Continued)

(58) Field of Classification Search
CPC ..... A41D 1/08; A41D 1/089; A41D 31/12; A41D 13/82; A41D 19/0013; A41D 2600/20
See application file for complete search history.

(56) References Cited

U.S. PATENT DOCUMENTS 2,308,337 A * 1/1943 McDonald ..... A41B 9/06 2/113
3,045,245 A * 7/1962 Kohen ..... A41D 13/0015 2/227
(Continued)

FOREIGN PATENT DOCUMENTS

CN 1871384 A 11/2006
CN 1920144 A 2/2007
(Continued)

OTHER PUBLICATIONS

International Preliminary Report on Patentability dated Jul. 26, 2018 in International Patent Application No. PCT/US2017/013307, 8 pages.
(Continued)

*Primary Examiner* — Richale L Quinn
(74) *Attorney, Agent, or Firm* — Shook, Hardy & Bacon L.L.P.

(57) ABSTRACT

A garment having one or more wipe zones for transferring away perspiration from a wearer's skin upon contact with the wearer's skin is provided herein. The wipe zones may be comprised of hydrophobic material formed from yarns having a smaller denier per filament (DPF) than adjacent non-wipe zones on the garment. In some aspects, the DPF of the wipe-zone material is within a range of 0.025 to 0.0025. The wipe zones may be positioned on an outer-facing surface of the garment or an inner-facing surface of the garment in areas that are readily accessible to remove perspiration from the wearer's hands and/or head. Methods of manufacturing a garment having wipe zones are also provided herein.

8 Claims, 11 Drawing Sheets

(51) Int. Cl.

| | |
|---|---|
| ***A41D 1/089*** | (2018.01) |
| ***A41D 13/00*** | (2006.01) |
| ***A41D 31/12*** | (2019.01) |
| ***A41D 1/04*** | (2006.01) |
| ***A41D 1/08*** | (2018.01) |
| ***A41D 27/20*** | (2006.01) |

(52) U.S. Cl.
CPC ..... *A41D 1/089* (2018.01); *A41D 13/0015* (2013.01); *A41D 27/20* (2013.01); *A41D 31/12* (2019.02); *A41B 2400/62* (2013.01)

(56) References Cited

U.S. PATENT DOCUMENTS 3,174,156 A * 3/1965 Dale ..... A41D 13/0015 2/115
3,511,608 A * 5/1970 Anderson ..... G01N 31/22 422/421
3,741,856 A * 6/1973 Hurst ..... C09J 7/22 442/150
3,911,498 A * 10/1975 Van Staagen ..... A41D 13/0015 2/74
4,232,128 A * 11/1980 Michel ..... A47L 13/16 521/134
4,541,129 A * 9/1985 Murakami ..... A41B 9/06 2/113
4,554,682 A 11/1985 Hillquist
4,603,440 A * 8/1986 Hale ..... A41D 27/10 2/115
4,608,715 A 9/1986 Miller et al.
4,651,348 A 3/1987 Swanson
4,768,236 A * 9/1988 Klob ..... A41D 13/0015 2/115
5,007,112 A 4/1991 Lewis, Jr. et al.
5,014,360 A * 5/1991 Smith ..... A41D 13/0015 2/115
5,065,600 A 11/1991 Byles
5,075,901 A * 12/1991 Vollrath ..... A41D 13/0015 2/113
5,090,060 A * 2/1992 Gates ..... A41D 13/0015 2/115
5,105,477 A 4/1992 Golde
5,164,253 A 11/1992 Greak
5,217,782 A 6/1993 Moretz et al.
5,441,436 A * 8/1995 Moretz ..... A41B 9/004 2/73
5,735,145 A 4/1998 Pernick
5,792,714 A * 8/1998 Schindler ..... A41D 13/005 442/194
5,889,737 A * 3/1999 Alameh ..... G04C 10/00 368/204
5,901,373 A * 5/1999 Dicker ..... A41D 31/02 2/243.1
5,906,876 A 5/1999 Conway
6,199,210 B1 3/2001 Feldman
6,276,178 B1 8/2001 West et al.
6,427,242 B1 8/2002 Bush et al.
6,432,504 B1 * 8/2002 Yeh ..... D03D 11/00 428/85
6,446,472 B2 9/2002 West et al.
6,782,557 B1 8/2004 Feder
6,848,118 B2 2/2005 Barnes et al.
6,854,130 B2 2/2005 van der Sleesen
7,043,766 B1 * 5/2006 Foreman ..... A41D 31/08 2/81
7,217,456 B1 * 5/2007 Rock ..... D04B 1/24 428/367
7,497,097 B2 3/2009 Herr
7,560,399 B2 7/2009 Rock et al.
7,565,920 B2 * 7/2009 Li ..... D03D 1/0017 139/420 A
7,682,994 B2 3/2010 Van Emden et al.
7,743,476 B2 6/2010 Rock et al.
7,842,625 B1 11/2010 Stockton et al.
7,842,628 B2 * 11/2010 Yasui ..... A41D 31/00 442/197
7,954,173 B2 6/2011 Collier
7,986,211 B2 7/2011 Kim et al.
D643,597 S 8/2011 Gaeir et al.
8,011,020 B2 9/2011 Vereen
8,051,495 B2 * 11/2011 Lee ..... A41B 9/00 2/113
8,176,569 B2 * 5/2012 Rock ..... F41H 1/02 2/2.5
8,578,518 B1 * 11/2013 Pflug ..... A41B 9/06 2/117
8,629,070 B2 1/2014 Oles et al.
8,713,712 B2 5/2014 Maurer
8,756,714 B2 6/2014 Reimer
8,769,716 B2 * 7/2014 Luscher ..... D06M 17/00 2/46
8,806,663 B2 8/2014 White et al.
8,850,615 B2 10/2014 Demarest et al.
9,038,203 B2 5/2015 Curtis
9,107,459 B2 * 8/2015 Mayer ..... B32B 5/026
9,559,742 B2 * 1/2017 Ye ..... A45C 11/00
9,677,207 B2 * 6/2017 Hurd ..... B32B 7/02
9,733,669 B1 * 8/2017 Scales ..... G06F 1/1633
9,829,923 B2 * 11/2017 Lee ..... G06F 1/1652
9,877,549 B2 * 1/2018 Perkins ..... F16B 2/14
9,894,964 B2 * 2/2018 Perkins ..... A44C 5/14
10,149,518 B1 * 12/2018 de Iuliis ..... G04B 37/1486
10,219,591 B2 * 3/2019 Hatanaka ..... G04B 37/1486
2003/0051286 A1 3/2003 Gregg
2004/0023578 A1 2/2004 Sobieski et al.
2004/0083529 A1 * 5/2004 Tate ..... A41D 27/20 2/115
2004/0132367 A1 7/2004 Rock
2004/0168479 A1 * 9/2004 McMurray ..... D04B 21/16 66/202
2005/0053759 A1 * 3/2005 Rock ..... D06M 23/16 428/91
2005/0086721 A1 * 4/2005 Lambertz ..... A41D 13/002 2/69
2005/0095940 A1 * 5/2005 Rock ..... D04B 1/24 442/304
2005/0176324 A1 * 8/2005 Michel ..... A41B 9/00 442/304
2005/0204449 A1 * 9/2005 Baron ..... A41D 13/0015 2/69
2005/0282455 A1 * 12/2005 Foshee ..... D04B 1/14 442/318
2006/0063453 A1 * 3/2006 King ..... D04B 21/00 442/318
2006/0148356 A1 * 7/2006 Zhang ..... D06M 13/432 442/310
2006/0277653 A1 12/2006 Okajima
2007/0093162 A1 4/2007 Holcombe et al.
2007/0149093 A1 * 6/2007 Lutz ..... D04B 1/246 450/1
2008/0070477 A1 * 3/2008 Barbour ..... A41C 3/0057 450/23
2008/0104739 A1 * 5/2008 Kharazmi ..... A41D 20/00 2/170
2008/0189824 A1 * 8/2008 Rock ..... A41D 31/18 2/69
2009/0049579 A1 2/2009 Roberts
2009/0095026 A1 4/2009 Araki et al.
2011/0099680 A1 5/2011 Gordon et al.
2011/0263418 A1 * 10/2011 Lu ..... D06M 15/00 502/402
2011/0302699 A1 12/2011 Kaneda et al.
2012/0064313 A1 3/2012 Rock et al.
2012/0096622 A1 4/2012 Johnson
2012/0174281 A1 7/2012 Mayer et al.
2012/0178343 A1 * 7/2012 Hurd ..... A41B 17/00 450/93
2012/0222189 A1 * 9/2012 Sokolowski ..... A41D 13/0015 2/69

(56) References Cited

U.S. PATENT DOCUMENTS

| | | | | |
|---|---|---|---|---|
| 2013/0042380 | A1* | 2/2013 | Goodman | A41D 31/12 2/69 |
| 2013/0045651 | A1 | 2/2013 | Esteves De Sousa Fangueiro et al. | |
| 2013/0061366 | A1* | 3/2013 | Pezzimenti | A41D 31/02 2/69 |
| 2013/0117903 | A1 | 5/2013 | Kanayama | |
| 2013/0239289 | A1 | 9/2013 | Iwashita | |
| 2014/0043741 | A1* | 2/2014 | Smith | H05K 5/02 361/679.3 |
| 2014/0106138 | A1 | 4/2014 | Chung et al. | |
| 2014/0310986 | A1 | 10/2014 | Tamm et al. | |
| 2015/0047103 | A1 | 2/2015 | Dahlgren et al. | |
| 2015/0104604 | A1 | 4/2015 | Rock et al. | |
| 2016/0076176 | A1* | 3/2016 | Rock | D04B 1/102 428/197 |
| 2017/0202287 | A1* | 7/2017 | Walter | A41D 31/12 |
| 2021/0145084 | A1* | 5/2021 | Szilagyi | A41D 13/0017 |

FOREIGN PATENT DOCUMENTS

| | | | |
|---|---|---|---|
| CN | 101128313 | A | 2/2008 |
| CN | 102134776 | A | 7/2011 |
| CN | 202890542 | U | 4/2013 |
| CN | 103243472 | A | 8/2013 |
| EP | 777978 | A2 | 6/1997 |
| EP | 2940203 | A1 | 11/2015 |
| WO | 2006002371 | A2 | 1/2006 |
| WO | 2007107264 | A1 | 9/2007 |
| WO | 2013/145456 | A1 | 10/2013 |
| WO | 2015/064636 | A1 | 5/2015 |

OTHER PUBLICATIONS

Final Office Action dated Nov. 7, 2018 in U.S. Appl. No. 14/996,629, 7 pages.

Non-Final Office Action dated Feb. 13, 2018 in U.S. Appl. No. 14/996,629, 8 pages.

International Preliminary Report on Patentability dated May 31, 2019 in International Patent Application No. PCT/US2017/061933, 11 pages.

International Search Report and Written Opinion dated Apr. 30, 2018 in International Patent Application No. PCT/US2017/061933, 20 pages.

Office Action received for European Patent Application No. 17817344.9, dated Jul. 1, 2020, 3 pages.

Non-Final Office Action received for U.S. Appl. No. 14/996,629, dated Oct. 7, 2020, 6 pages.

Intention to Grant received for European Patent Application No. 17817344.9, dated Apr. 28, 2021, 4 pages.

Office Action received for European Patent Application No. 17703509.4, dated Apr. 29, 2021, 7 pages.

Office Action received for European Patent Application No. 17703509.4, dated Aug. 12, 2020, 4 pages.

International Search Report and Written Opinion dated Apr. 13, 2017 in International Patent Application No. PCT/US2017/013307, 15 pages.

* cited by examiner

GARMENT WITH WIPE ZONES

CROSS-REFERENCE TO RELATED APPLICATIONS

This application having attorney docket number NIKE.281562/160117US02 and entitled "GARMENT WITH WIPE ZONES" claims the benefit of priority of U.S. Provisional Application No. 62/423,011, entitled "GARMENT WITH WIPE ZONES," and filed on Nov. 16, 2016, which is incorporated by reference in its entirety.

TECHNICAL FIELD

The present disclosure relates to garments having wipe zones to provide a mechanism for transferring away moisture from the wearer's body.

BACKGROUND

It is often desirable to use one's own garment to wipe away perspiration during physical activity. However, garments worn during physical activities are not often designed to effectively remove moisture.

BRIEF DESCRIPTION OF THE DRAWINGS

Aspects herein are described in detail herein with reference to the attached drawing figures, wherein.

DETAILED DESCRIPTION

Figure 1:
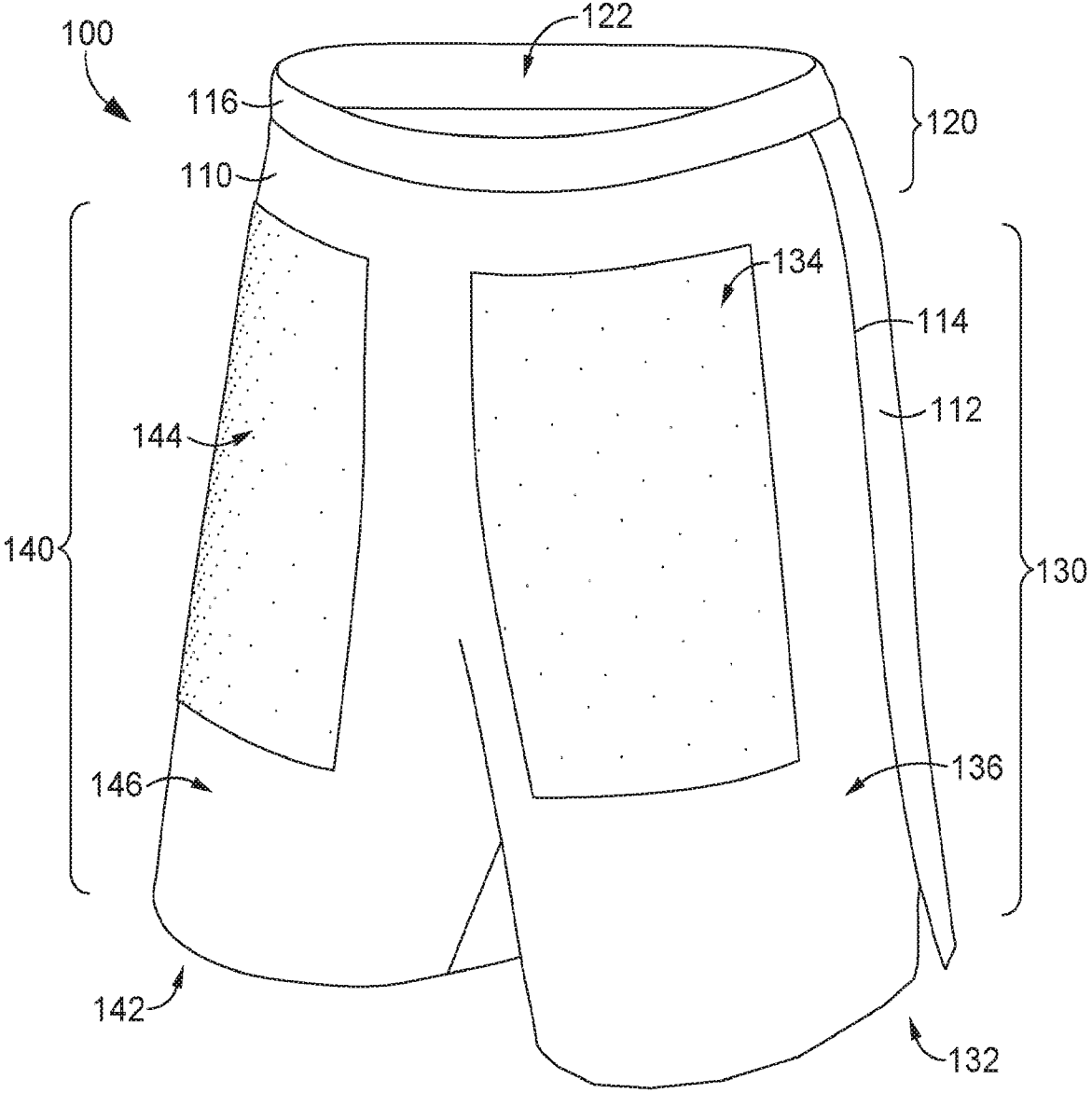
FIG. 1 depicts a front perspective view of an exemplary lower-body garment comprising wipe zones in accordance with aspects herein.

The subject matter of aspects provided herein is described with specificity to meet statutory requirements. However, the description itself is not intended to limit the scope of this disclosure. Rather, the inventors have contemplated that the disclosed or claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

During exercise, athletes often have a need or a desire to wipe away perspiration, especially when perspiration is dripping into the athlete's eyes or preventing him or her from maintaining a proper hand grip on equipment. Oftentimes, a person who is engaged in a physically demanding activity will carry a towel to wipe away perspiration. However, having to carry a towel around is often cumbersome, and once the towel becomes saturated, the towel is ineffective for its intended purpose. The most convenient tool for wiping away the perspiration often ends up being the athlete's own garments. However, garments traditionally worn for physical activities are usually made from materials designed to aid in ventilation and are not necessarily configured to facilitate the wiping away of large amounts of moisture. For example, garments made from hydrophilic materials retain or absorb the moisture, which causes the garment itself to eventually become saturated with perspiration or other fluids, rendering the garment ineffective in wiping away further perspiration, similar to the towel. Other garments used for athletic activities are made from materials with low absorptive abilities, which may limit the amount of perspiration that can be wiped away. Accordingly, aspects herein contemplate integrating materials into athletic garments to provide strategically placed wipe zones that are easily accessible to the wearer for wiping away perspiration. The materials are configured to have 1) a high amount of surface area available for contact, and 2) an ability to facilitate the movement of moisture collected on the surface of the material away from the surface of the material via capillary action.

The wipe zones described herein comprise a material formed from a yarn with a very small denier per filament (DPF) compared to the material in other parts of the garment. For instance, in exemplary aspects, the denier of the yarn may be between 25 and 35 and the number of filaments in the yarn may be between 8550 and 8570 filaments. This results in the DPF of the yarn making up the wipe zones being within a range of 0.025 to 0.0025. The small DPF means that a large number of filaments are concentrated within a smaller area. The increased number of filaments provides a high surface area with which perspiration may be removed from the wearer's body through, for instance, a wiping motion, and additionally, the high number of filaments in the yarn allows for the perspiration to be removed by a capillary action (the ability of liquid to flow in narrow spaces, such as narrow channels between filaments in yarn, without the assistance of external forces). In exemplary aspects, the yarn used in the material for the wipe zones may be hydrophobic in that it does not readily absorb moisture. Rather, the perspiration is stripped from the wearer's body by the high surface area of the wipe zone material, and then may bead up and fall to the floor, allowing the material to be utilized to wipe away more perspiration without become saturated.

The wipe zones may be used in various garments, including upper-body garments and lower-body garments, and may be strategically positioned in areas naturally used by wearers for wiping away sweat. For instance, in some aspects, the wipe zones are on a pair of shorts and may be positioned on an outer-facing surface on the front of the leg portions of the shorts or may be positioned on a portion of the shorts covering the wearer's lower back. In other aspects, wipe zones may be located on an upper-body garment, such as a t-shirt or a jersey. The wipe zones may be part of an outer-facing surface near a bottom portion of the front of the upper-body garment or may be part of an inner-facing surface along the neck line of the upper-body garment. These locations take advantage of a wearer's tendency to remove perspiration by either pulling up the bottom of the garment to wipe his or her face or pulling up the neck line portion of the garment to wipe his or her face.

Accordingly, aspects of the disclosure include a garment comprising a first zone and a second zone adjacent the first zone. The first zone comprises a first material formed from yarns having a first denier per filament (DPF), and the second zone adjacent the first zone comprises a second material formed from yarns having a second DPF. The first DPF may be greater than the second DPF, which may be within a range of 0.025 to 0.0025. In some aspects, the second material is hydrophobic.

In another aspect, a lower-body garment comprises a torso portion adapted to cover at least a lower torso area of a wearer when the lower-body garment is worn by the wearer, a first leg portion extending from the torso portion, and a second leg portion extending from the torso portion. The torso portion, the first leg portion, and the second leg portion may define at least a waist opening, a first leg opening, and a second leg opening. One or more portions of the lower-body garment may include a wipe zone comprising a first material formed from yarns having a first denier per filament (DPF) within a range of 0.025 to 0.0025.

A further aspect of the present disclosure includes a method of manufacturing a garment. The method may comprise providing a first panel and a second panel. The first panel may comprise a first material formed from yarns having a first denier per filament (DPF), while the second panel may comprise a second material formed from yarns having a second DPF that is within a range of 0.025 to 0.0025. The method may further include securing the second panel to the first panel to form at least a portion of the garment. In some aspects, prior to securing the second panel to the first panel, a portion of the first panel may be removed to create an opening in the first panel defined by a plurality of edges, and securing the second panel to the first panel may include securing portions of the second panel to the first panel adjacent the plurality of edges, the second panel being configured to be positioned between the plurality of edges of the first panel. In other aspects, the first panel may have an outer-facing surface and an inner-facing surface. Securing the first panel to the second panel may include securing at least portion of the second panel to at least a portion of the outer-facing surface of the first panel or to at least a portion of the inner-facing surface of the first panel.

Turning now to the figures, FIG. 1 depicts a front perspective view of an exemplary garment 100 comprising wipe zones in accordance with aspects of the present disclosure. The garment 100 comprises a front panel 110 and a back panel 112 joined by two lateral seams forming a left lateral seam line 114 and an opposite right lateral seam line (not shown). The garment in FIG. 1 comprises a waistband 116 joined to the front panel 110 and the back panel 112.

Although the garment 100 in FIG. 1 is depicted as comprising a front panel 110 and a back panel 112, one of ordinary skill in the art will recognize that the number of panels needed to construct the garment 100, as well as additional aspects described herein, may change depending on the type of construction method used and/or the style of garment being constructed. For example, the garment 100 may be circular knit in a single piece where the fabric is knit to have no seam lines, or may be flat knit or woven as a single piece to have a single seam line. Alternatively, the garment 100 may be constructed from three, four, five, etc., number of panels with three, four, five, etc., number of seam lines. Similarly, although a separate waistband is shown, it is contemplated herein that the front panel 110 in combination with the back panel 112 may form the waist opening for the garment 100. Any and all aspects, and any variation thereof, are contemplated as being within aspects herein.

Additionally, in FIG. 1, the garment 100 shown is a pair of knee-length shorts; however, it is contemplated herein that the garment 100 may be in the form of shorter shorts, long pants, three-quarter length pants, capri-pants, mini-skirt, knee-length skirt, long skirt, skorts of different lengths, and the like, without departing from aspects herein. In aspects, the garment 100 may comprise optional pockets with pocket openings adjacent to an upper portion of the left lateral seam line 114 and opposite right seam line, although it is contemplated herein that pockets may be located at other portions of the garment 100. Further, as discussed with respect to FIGS. 7-9, aspects of the disclosure include upper-body garments having one or more wipe zones. Exemplary upper-body garments include short sleeved shirts, tank tops, long-sleeved shirts, hoodies, short or long sleeved sweaters, jackets, and the like.

Focusing on the lower-body garment 100 in FIG. 1, the front and back panels 110 and 112, respectively, form different portions of the garment 100. For instance, a torso portion 120 of the garment 100 may be formed by the waistband 116 and at least superior portions of the front panel 110 and the back panel 112. The torso portion 120 may define a waist opening 122 and be adapted to cover at least a lower torso area of a wearer when the garment 100 is worn by the wearer. Additionally, the garment 100 may include a first leg portion 130 and a second leg portion 140 each extending from the torso portion 120 and each being formed by at least part of the front panel 110 and the back panel 112. When the garment 100 is worn, the first leg portion 130 may be adapted to cover at least part of the left leg of the wearer while the second leg portion 140 may be adapted to cover at least a portion of the right leg of the wearer. The first leg portion 130 and the second leg portion 140 may define a first leg opening 132 and a second leg opening 142, respectively. As mentioned, in some aspects not shown, the garment 100 does not include a waistband, and, instead, the torso portion 120 and the waist opening 122 are defined by only the front panel 110 and back panel 112. It is understood that these portions 120, 130, and 140 are not intended to demarcate precise areas of the garment 100 but, rather, are intended to represent general areas of the garment 100 to aid in various descriptions in this disclosure.

As used throughout this disclosure, positional terms used when describing, for instance, a garment or portions of a garment, such as "anterior," "posterior," "inferior," "superior," "lateral," "medial," "superior," and the like are to be given their common meaning with respect to the garment being worn by a hypothetical wearer standing in anatomical position.

As previously mentioned, the garment 100 includes wipe zones adapted to wipe away perspiration or other fluid away from the wearer's skin upon contact with the wearer's skin. The garment 100, as shown in FIG. 1, includes a first wipe zone 134 adjacent a first non-wipe zone 136 on the first leg portion 130 and a second wipe zone 144 adjacent a second non-wipe zone 146 on the second leg portion 140. It is contemplated that the first non-wipe zone 136 and the second non-wipe zone 146 may be different areas of the same panel of material or may comprise separate panels of materials.

The first and second wipe zones 134 and 144, respectively, and the first and second non-wipe zones 136 and 146, respectively, may comprise woven or knitted fabrics. In some aspects, the woven or knitted fabrics are hydrophobic fabrics. The fabrics used may be inherently hydrophobic due to, for instance, forming the fabrics from hydrophobic yarns/fibers such as polyester and nylon. Alternatively, the fabrics used may be natural or synthetic fabrics that are made hydrophobic by applying a hydrophobic coating, such as a durable water repellent (DWR) coating, to one or both surfaces of the fabric. Exemplary natural fibers include cotton, hemp, silk, and the like. When woven, the fabrics may exhibit high durability characteristics and be resistant to snagging. Further, the fabrics, when woven, may hold their shape, be less susceptible to shrinking and/or stretching, and be able to withstand multiple wash cycles without being deformed. Additionally, the fabrics may be stretch woven or knit, or in other words, the fabrics may be formed with added elasticity by interweaving or interknitting elastic yarns/fibers, such as elastane.

In exemplary aspects, the first and second wipe zones 134 and 144, respectively, each comprise a first material, and the first and second non-wipe zones 136 and 146, respectively, each comprise a second material. The first and second materials may be formed from yarns have varying denier per filament (DPF) measurements. Denier generally describes the fineness or coarseness of yarns or fibers and, specifically, is the weight in grams of 9,000 meters of fiber or yarn. DPF is way of identifying fiber size and is calculated by dividing the yarn denier by the number of filaments. As previously mentioned, the first and second wipe zones may comprise a material formed from yarns with a very small DPF. Accordingly, yarns forming the first material used for the first and second wipe zones 134 and 144, respectively, may have a first DPF, while yarns forming the second material used for the first and second non-wipe zones 136 and 146, respectively, may have a second DPF that is greater than the first DPF.

Figure 2B:
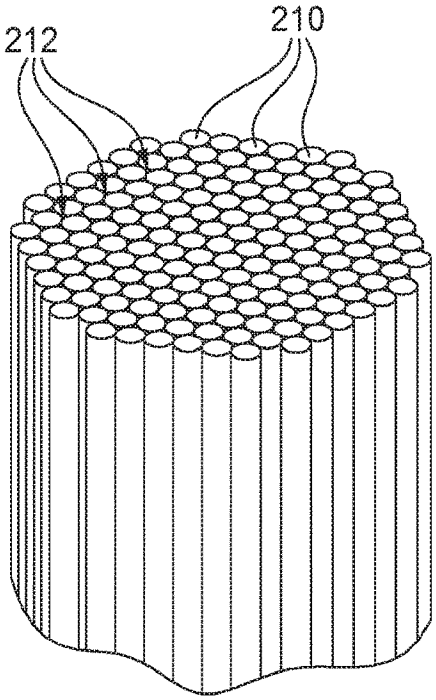
FIGS. 2A and 2B depict a close-up view of an exemplary yarn used to form a wipe zone in accordance with aspects herein.
Figure 2A:
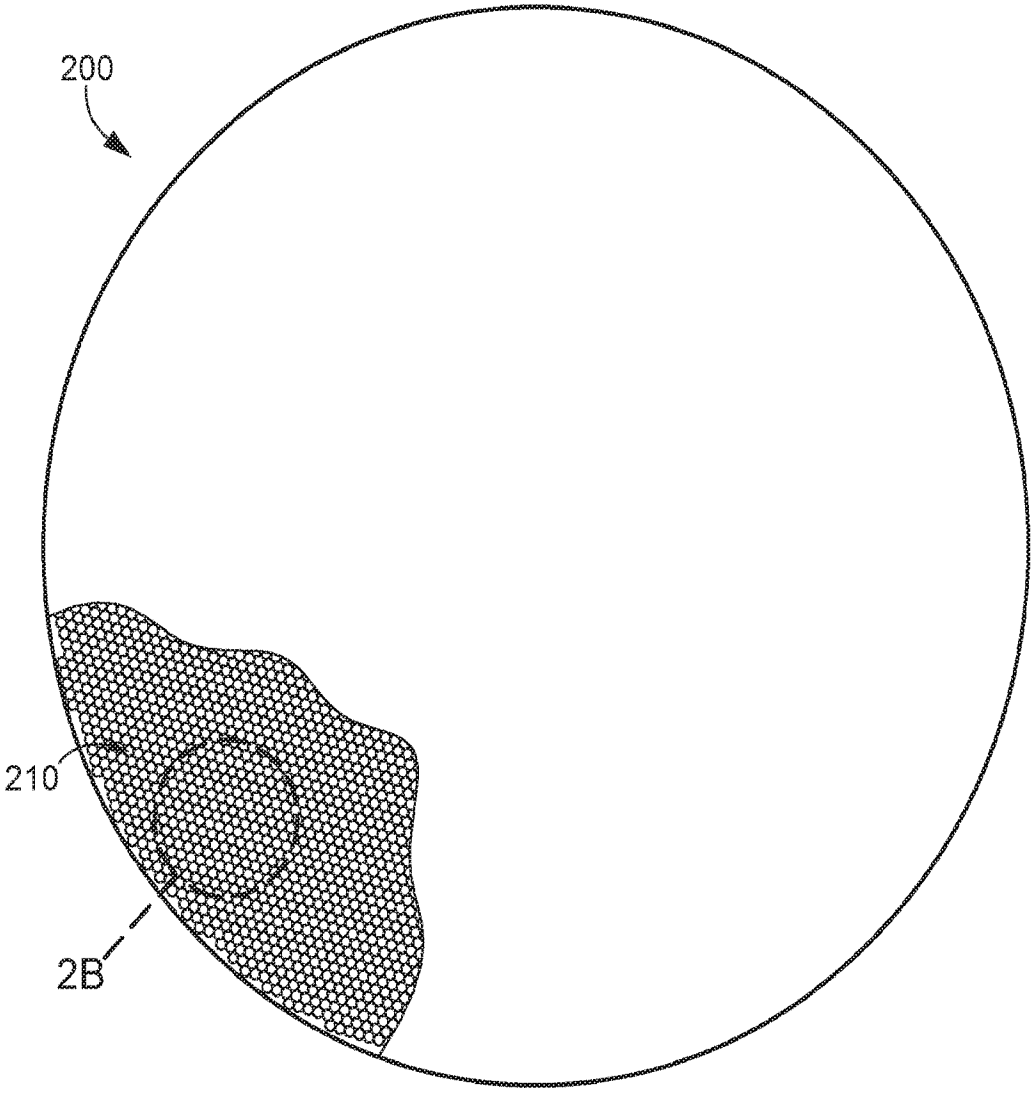

FIGS. 2A-2B illustrate the DPF of an exemplary yarn 200 for the first material for the wipe zones by providing close-up views of a portion of the exemplary yarn 200 for the first material in accordance with aspects herein. The yarn 200 comprises a plurality of filaments 210, or strands of fibers. The filaments 210 are compacted together and form narrow channels 212 between the adjacent filaments 210. In exemplary aspects, the first DPF of the yarns forming the first material making up the first and second wipe zones 134 and 144, respectively, is within a range of 0.025 to 0.0025. In some aspects, the yarn for the first material has a denier within a range of 20 to 40 and comprises a number of filaments within a range of 8,000 to 9,000. For example, although not all the filaments are illustrated in FIG. 2A, exemplary yarn 200 has a denier of 30 and comprises approximately 8560 filaments, resulting in the first DPF being approximately 0.0035 DPF. In exemplary aspects, the yarn 200 is hydrophobic. Exemplary yarns may include the Nanofront™ yarn manufactured by Teijin Limited having headquarters in Tokyo, Japan.

In some aspects, the exemplary yarn 200 is formed through a bi-component matrix process, which may also be referred to as "islands in the sea." Accordingly, when the yarn 200 is being formed, the filaments 210 may be bundled together into a plurality of groups or "islands" surrounded by a matrix of a polymer material, such as nylon. It is contemplated that other suitable polymer materials may be used as the matrix. Then, as a post-processing step, the matrix polymer may be dissolved by water or a solution. When the matrix polymer dissolves, the filaments 210 may split apart and disperse to increase the number of filaments.

The first material comprising the first and second wipe zones, 134 and 144, respectively, is designed to efficiently wick away moisture from a person's skin when the material is in contact with the skin. Specifically, the first material being formed by yarns having a very small DPF, such as a DPF within a range of 0.025 to 0.0025, provides multiple mechanisms for transferring a large amount of moisture from a person's skin. First, as described above with respect to the yarn 200, the yarns forming the first material comprise a large number of filaments to provide an increased surface area for the first material. The increased surface area caused by the yarns of the first material provides a greater surface area for contact with a person's skin, thereby increasing the amount of perspiration that the first material may contact (and therefore remove) when the wearer rubs his or her hands (or any other body part) against the first material.

Additionally, the small DPF of yarns making up the first material may also provide a capillary action to more efficiently wick away moisture. As previously mentioned, the tightly compacted filaments 210 of the yarn 200 for the first material create narrow channels 212 between adjacent filaments 210. These channels 212 have diameters that are sufficiently small such that the surface tensions of the perspiration (or other fluids) and the adhesive forces between the perspiration and the filaments act to propel the perspiration further into the channels 212 without the assistance of external forces. Thus, moisture may be removed from the outer surface of the first material via capillary action between the filaments 210, thereby leaving the surface of the first material free to transfer away additional moisture from the wearer's skin.

Further, in aspects in which the yarns are hydrophobic, the first material does not become saturated with the moisture it removes, but, instead, the moisture captured by the yarns of the first material may bead up and fall off the garment 100. The combination of the increased surface area, the capillary action, and, in some aspects, the hydrophobic nature provides a greater capacity of the first material of the first and second wipe zones 134 and 144, respectively, to wipe away perspiration and other moisture from a wearer's skin when compared to the second material of the first and second non-wipe zones, 136 and 146, respectively.

In some aspects, the first material comprises only yarns having a DPF between 0.025 to 0.0025. In other aspects, the first material includes different types of yarn with at least one type of yarn having a DPF between 0.025 to 0.0025. For example, the first material may include an outer-facing surfacing surface comprising yarn with a DPF between 0.025 and 0.0025 and a backing or an inner-facing surface comprising a yarn with a higher DPF, such as a nylon or polyester yarn. This construction may be achieved by plating or double-knitting the polyester yarn or the nylon yarn with the yarn having a DPF between 0.025 and 0.0025 such that the yarn having a DPF between 0.025 and 0.0025 forms a first surface, such as an outer-facing surface, interlocked with the polyester yarn or nylon yarn forming a second surface, such as an inner-facing surface.

In additional aspects, the material used for the wipe zones further includes at least one textured surface comprising raised structures. In exemplary aspects, the raised structures may be formed by dropping in yarns via a knitting or weaving process and/or by modifying the knitting or weaving process used to form the first material so as to integrally knit or weave the raised structures. Because the raised structures help to further increase the surface area of the first material, the raised structures may increase the first material's ability to transfer fluids away from the wearer's skin and may be arranged in a suitable pattern to provide a desired moisture removal effect while also being aesthetically appealing.

Similarly, the wipe zones 134 and 144 may have a shape and size that is both suitable for its intended purpose and, at the same time, is aesthetically appealing. Turning back to FIG. 1, for instance, the first wipe zone 134 and the second wipe zone 144 of garment 100 in FIG. 1 each comprise a rectangular shape with the longitudinal axis of the zones 134 and 144 being parallel to a longitudinal axis of the garment 100. Although the wipe zones 134 and 144 are shown as having a rectangular shape, it is contemplated that they may assume different shapes. It is similarly contemplated that additional configurations may be used while still being easily accessible to, for example, the wearer's hands. Additionally, as shown, the first and second wipe zones 134 and 144, respectively, comprise a plurality of wipe zone areas covering the first and second leg portions 130 and 140, respectively, instead of being a unitary zone.

In exemplary aspects, the first and second wipe zones 134 and 144, respectively, may be present in only the front panel 110 of the garment 100 and may form at least 50% of the total area of the front panel 110. In additional exemplary aspects, the first and second wipe zones 134 and 144, respectively, may form at least 70% of the front panel 110 of the garment 100. In other aspects, the first and second wipe zones 134 and 144, respectively, extend into the back panel 112 of the garment 100. Additionally, the back panel 112 may comprise additional or alternative wipe zones, such as the aspect illustrated in FIG. 5.

The first wipe zone 134 and the second wipe zone 144 are positioned on the anterior aspect of the garment 100. Specifically, the first and second wipe zones 134 and 144, respectively, make up at least a portion of the outer-facing surface of the first and second leg portions 130 and 140, respectively, of the garment 100. The first and second wipe zones 134 and 144, respectively, are configured to cover at least a wearer's quadriceps or a portion of the wearer's upper legs when the garment 100 is worn. With this position, the first and second wipe zones 134 and 144, respectively, are readily accessible to the wearer for quickly wiping his/her palms with a generally downward or sideways motion to wipe or wick away perspiration when needed. Being able to quickly remove perspiration from hands may be particularly useful in sports such as basketball, baseball, or tennis where hands are heavily involved because, by alleviating the slippery nature of sweaty or wet hands, the athlete may have a better control of the ball, bat, or racquet, depending on the sport or position being played.

Figure 3:
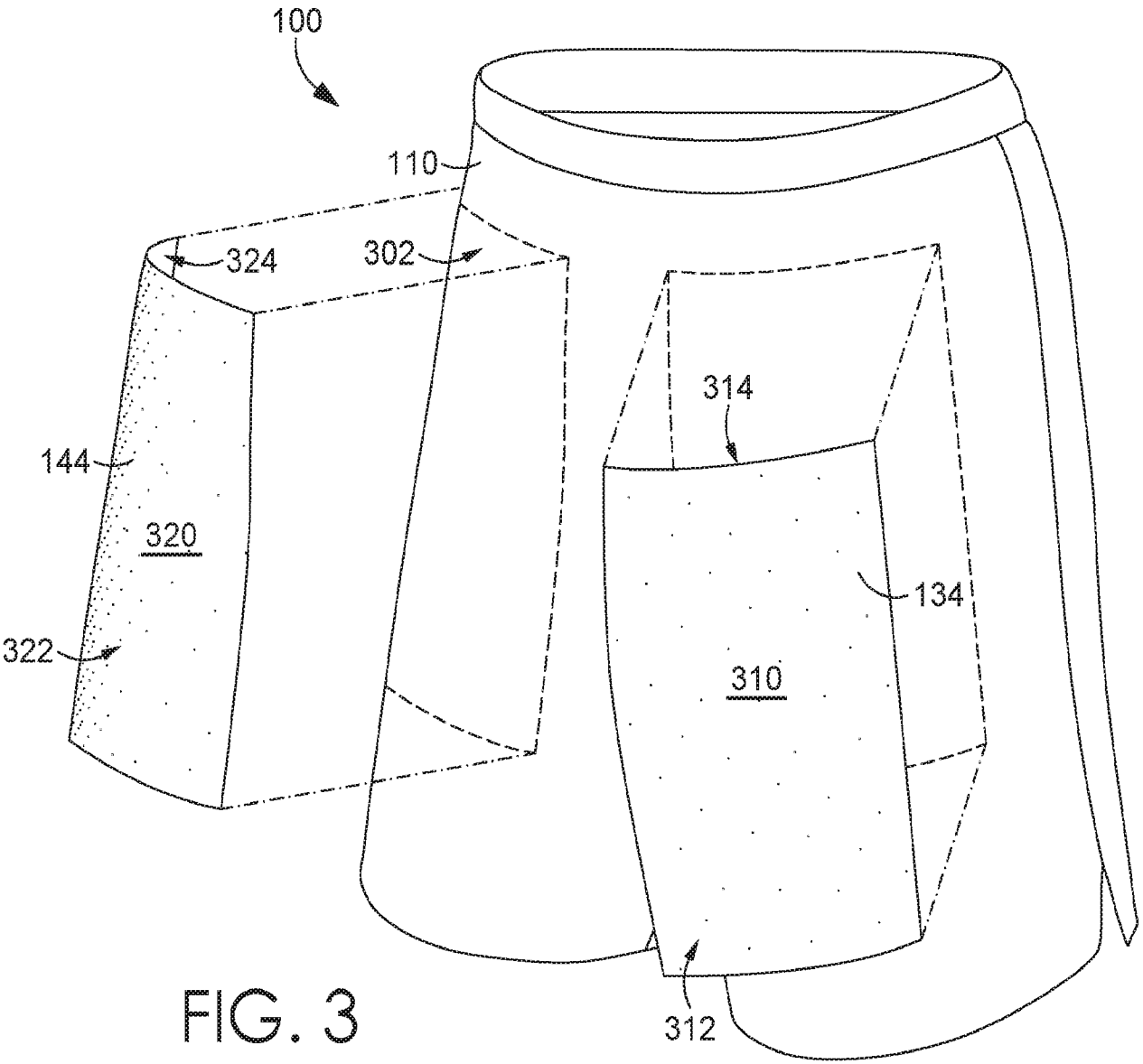
FIG. 3 depicts an exploded view of an exemplary lower-body garment with wipe zone overlay panels in accordance with aspects herein.

The first and second wipe zones 134 and 144, respectively, may be integrated into the garment 100 as an overlay of another panel of material or may be inserted over or into openings in another panel of material forming the garment 100. Turning to FIG. 3, for instance, an exploded view of the garment 100 is provided where the first wipe zone 134 and the second wipe zone 144 are configured as overlays on the material forming the front panel 110. The front panel 110 may comprise an outer-facing surface 302 and an inner-facing surface (not shown) opposite the outer-facing surface 302. Similarly, the first wipe zone 134 may comprise a first panel 310 having an outer-facing surface 312 and an inner-facing surface 314, and the second wipe zone 144 may comprise a second panel 320 having an outer-facing surface 322 and an inner-facing surface 324.

The inner-facing surface 314 of the first panel 310 may be attached to at least a first portion of the outer-facing surface 302 of the front panel 110, and the inner-facing surface 314 of the second panel 320 may be attached to at least a second portion of the outer-facing surface 302 of the front panel 110. In this manner, the first panel 310 and the second panel 320 overlay or are positioned adjacent to different portions of the front panel 110 of the garment 100 such that portions of the front panel 110 are interior to the first and second panels 310 and 320, respectively.

Attaching the first panel 310 and the second panel 320 to portions of the front panel 110 may be done by permanently affixing or securing these panels together by, for example, stitching, adhesives, bonding, and the like. In other aspects, the panels may be removeably affixed to one another by, for instance, buttons, zippers, snap closures, hook-and-loop fasteners, and the like. Although the specific type of technology used to secure the different panels of the garment 100 is not shown in FIG. 3, it is understood that FIG. 3 is meant to encompass any of the aforementioned types of affixing technologies.

Figure 9:
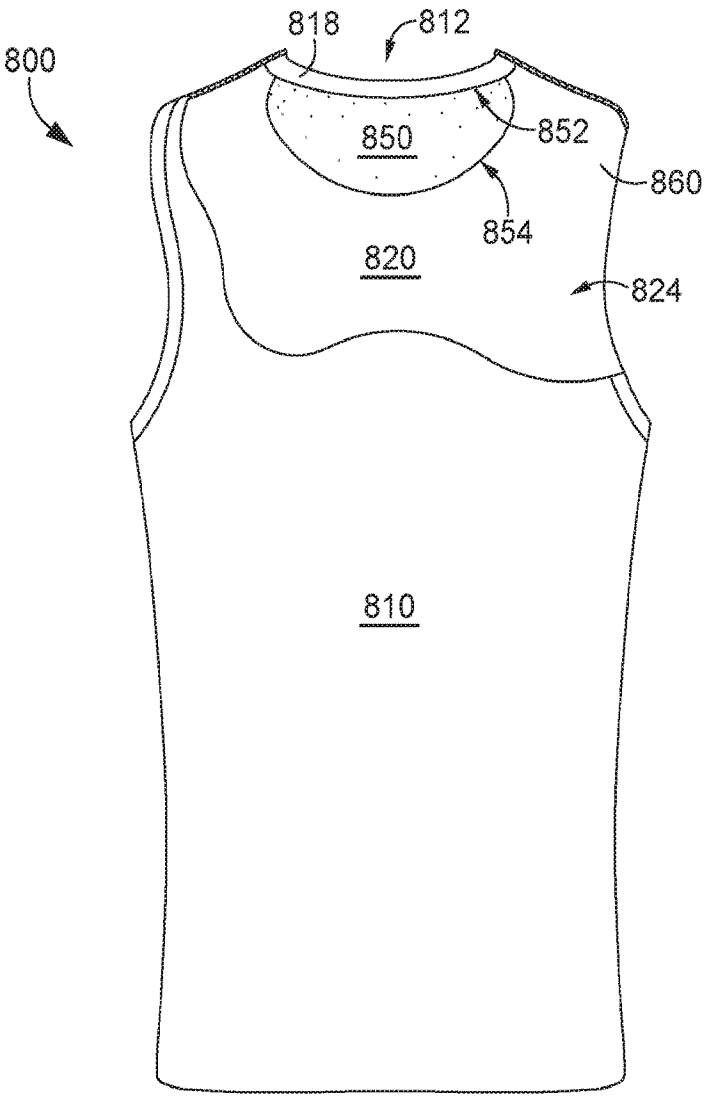
FIG. 9 depicts a front view of an exemplary upper-body garment having a wipe zone with a portion of the front panel cut away to show the inner-facing surface of the back panel in accordance with aspects herein.
Figure 8:
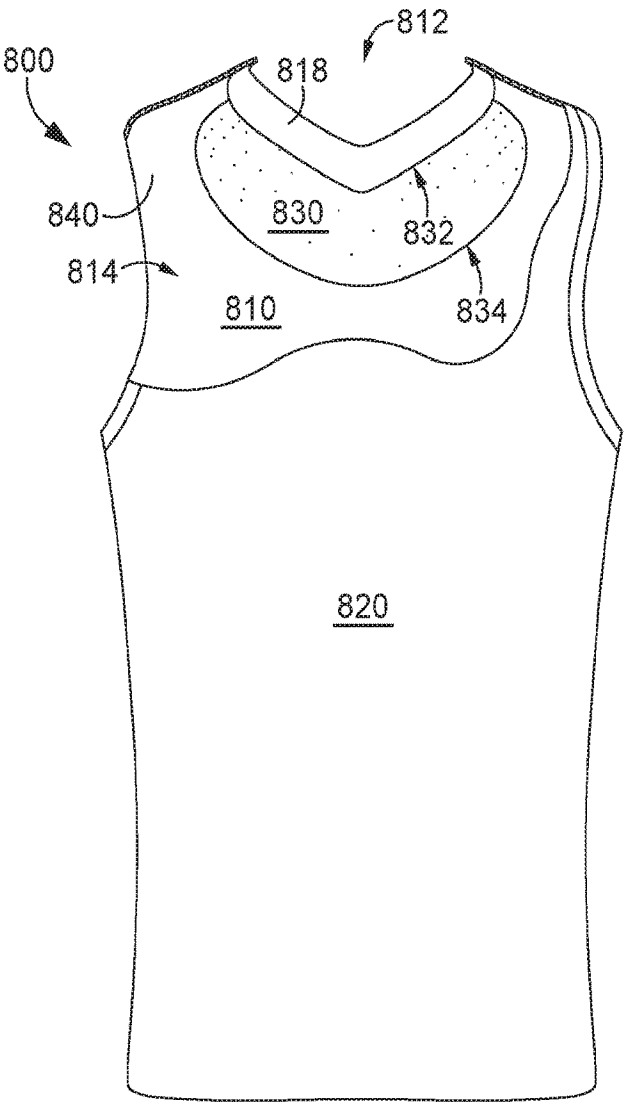
FIG. 8 depicts a back view of an exemplary upper-body garment having a wipe zone with a portion of the back panel cut away to show the inner-facing surface of the front panel in accordance with aspects herein.

Because the first and second panels 310 and 320, respectively, are attached to portions of the outer-facing surface 302 of the front panel 110, the first and second wipe zones 134 and 144, respectively, may be used to wipe away perspiration and moisture from a person's skin exterior to the garment 100. However, it is also contemplated that wipe zones may overlay or be positioned adjacent to inner-facing surfaces of a front panel to wipe or wick away perspiration interior to the garment as shown in FIGS. 8-9.

Figure 4:
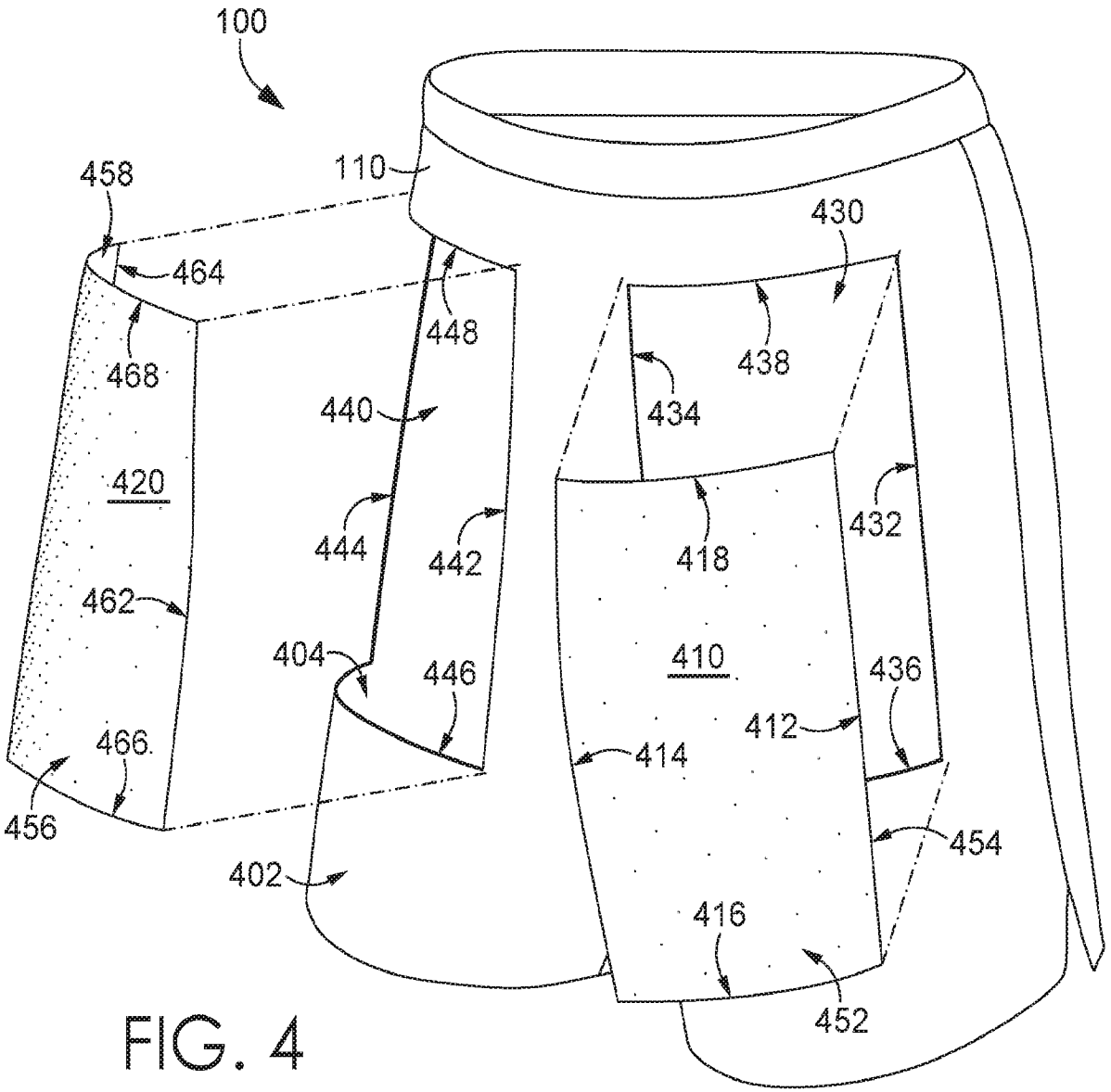
FIG. 4 depicts an exploded view of an exemplary lower-body garment with wipe zone panels inserted over openings in the garment in accordance with aspects herein.

FIG. 4 depicts an alternative construction for the garment 100 with the wipe zones covering openings in a base layer, such as the front panel 110, in accordance with aspects herein. As shown in FIG. 4, the front panel 110 may include one or more openings, such as a first opening 430 and a second opening 440. The first opening 430 may be defined by a plurality of perimeter edges of the front panel 110 that together form a rectangular shape generally corresponding to the shape of the first panel 410 making up the first wipe zone 134. The plurality of edges may include, for example, a left side edge 432, a right side edge 434, a lower edge 436 and an upper edge 438 while the first panel 410 may be defined by a left side edge 412, a right side edge 414, a lower edge 416 and an upper edge 418. Likewise, the second opening 440 may be defined by a plurality of edges of the front panel 110 that together form a rectangular shape generally corresponding to the shape of the second panel 420 making up the second wipe zone 144. The plurality of edges defining the second opening 440 may also include a left side edge 442, a right side edge 444, a lower edge 446 and an upper edge 448 while the second panel may be defined by a left side edge 462, a right side edge 464, a lower edge 466 and an upper edge 468.

Integrating the first wipe zone 134 and the second wipe zone 144 into the garment 100 may include securing portions of the perimeter of the first and second panels, 410 and 420, respectively, to portions of the front panel 110 near or proximate to the first and second openings, 430 and 440, respectively. Specifically, using the first panel 410 as an example, a portion of the first panel 410 adjacent the left side edge 412 may be secured to the front panel 110 adjacent the left side edge 432 of the front panel 110, a portion of the first panel 410 adjacent the right side edge 414 may be secured to the front panel 110 adjacent the right side edge 434 of the front panel 110, a portion of the first panel 410 adjacent the lower edge 416 may be secured to the front panel 110 adjacent the lower edge 436 of the front panel 110, and a portion of the first panel 410 adjacent the upper edge 418 may be secured to the front panel 110 adjacent the upper edge 438 of the front panel 110. The second panel 420 may be secured to the front panel 110 in a similar fashion with respect to the edges 442, 444, 446, and 448 defining the second opening 440.

Attaching the first panel 410 and the second panel 420 to portions of the front panel 110 may be done by permanently affixing or securing these panels together by, for example, stitching, adhesives, bonding, and the like. In other aspects, the panels may be removeably affixed to one another by, for instance, buttons, zippers, snap closures, hook-and-loop fasteners, and the like. Although the specific type of technology used to secure the different panels of the garment 100 is not shown in FIG. 4, it is understood that FIG. 4 is meant to encompass any of the aforementioned types of affixing technologies.

When secured to the front panel 110 in this way, at least a majority of the first panel 410 is positioned between the edges 432, 434, 436, and 438 defining the first opening 430 and at least a majority of the second panel 420 is positioned between the edges 442, 444, 446, and 448 defining the second opening 440. As such, at least parts of the first panel 410 and the second panel 420 may form both an outer surface and an inner, skin-contacting surface of the garment 400. In other aspects, the first panel 410 and the second panel 420 may not form an interior, skin-contacting surface, for instance, where the front panel 110 is a double-layered panel with only openings in the outer layer or where the garment 400 includes a lining layer interior to the front panel 110.

Figure 6:
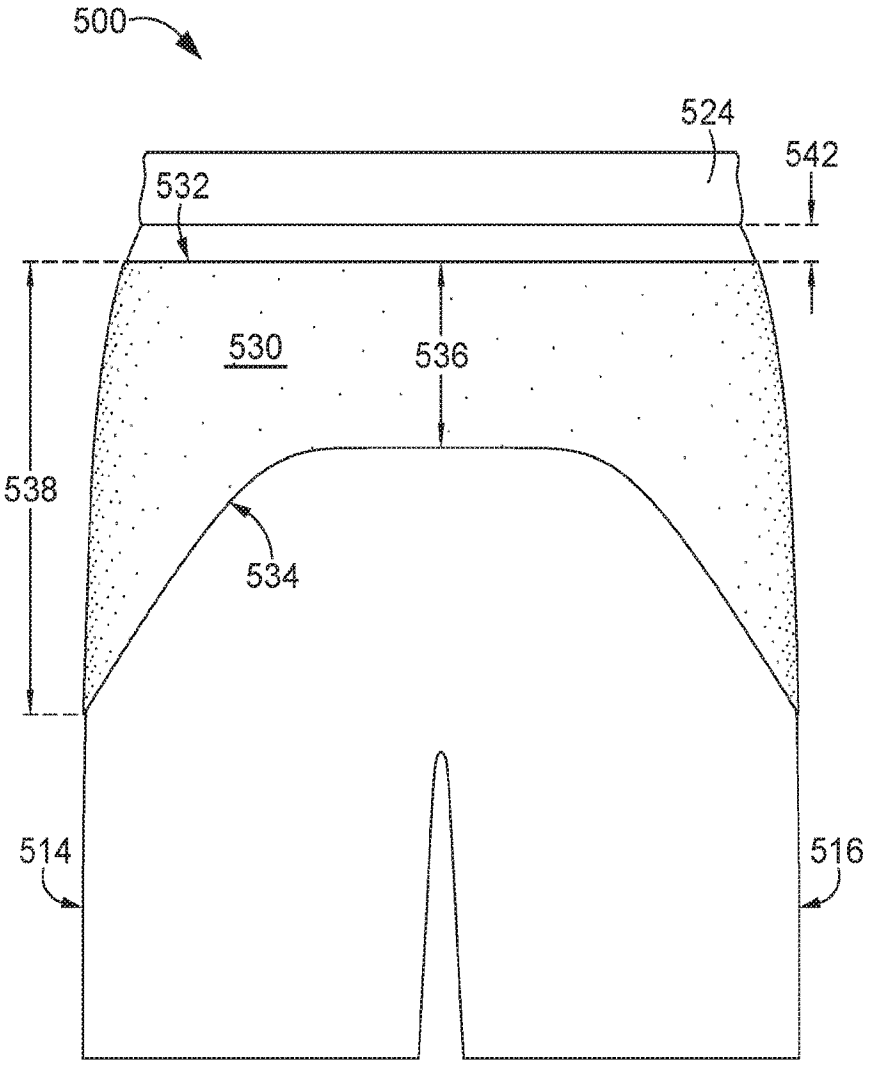
FIG. 6 depicts a back view of the exemplary lower-body garment of FIG. 5 in accordance with aspects herein.
Figure 5:
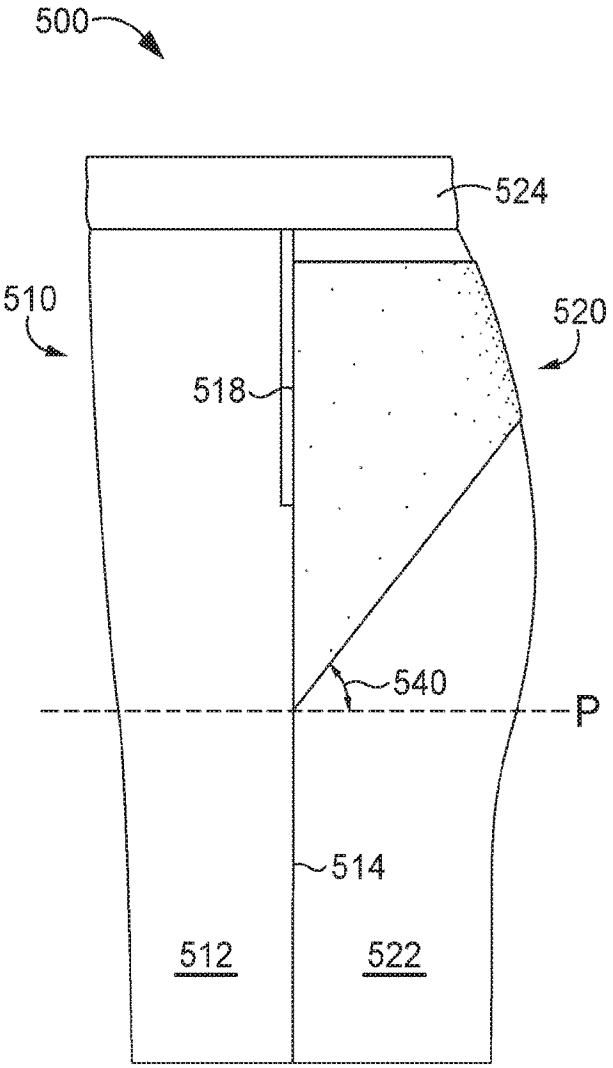
FIG. 5 depicts a side view of an exemplary lower-body garment with a wipe zone in accordance with aspects herein.

As previously discussed, the shape and size of the wipe zones and their positioning on the garment are configured to aid the wearer in readily removing perspiration while wearing the garment. For instance, the first and second wipe zones 134 and 144, respectively, of the garment 100 overlay or form an outer-facing surface of the front panel so that a wearer can readily access the wipe zones to remove perspiration from his or her hands. It is contemplated that there may be alternative positioning of wipe zones that will also provide a readily accessible means of quickly removing perspiration from the wearer's hands. For example, FIGS. 5 and 6 illustrate garment 500 having an alternative wipe zone configuration. Similar to garment 100 of FIG. 1, garment 500 is a pair of knee-length shorts comprising a front panel 512 forming an anterior aspect 510 of the garment 500 and a back panel 522 forming a posterior aspect of the garment 500. The front panel 512 and the back panel 522 are joined by two lateral seams forming a left lateral seam line 514 and an opposite right lateral seam line 516. One or more of the lateral seam lines 514 and 516 may be aligned with a pocket opening 518.

Garment 500 includes a wipe zone 530 extending across the posterior aspect 520 of the garment 500 that is configured to cover a lower back torso of a wearer when worn. For example, the wipe zone 530 may extend horizontally across the garment 500 from the left lateral seam line 514 to the right lateral seam line 516 when the garment 500 is in an as-worn configuration. In exemplary aspects, the wipe zone 530 is proximate to an upper margin 524 of the garment 500, which may be a waistband of the garment 500. As used herein, the term "proximate" means within 0.0 centimeters to 10.0 centimeters of a designated reference point, such as the upper margin 524 of the garment 500. An upper edge 532 of the wipe zone 530 may lie at a uniform distance 542 away from the upper margin 524. In other aspects, the upper edge 532 of the wipe zone 530 abuts the upper margin 524 of the garment 500.

As illustrated in FIG. 6, the wipe zone 530 may have an irregular shape with an upper edge 532 of the wipe zone 530 being substantially parallel to the upper margin 524 of the garment and a lower edge 534 that is curved or tapers superiorly towards a vertical midline (not shown) at an angle 540 measured in reference to a perpendicular plane P (as shown in FIG. 5). In this way, the wipe zone 530 may have a height 536 at the vertical midline that is smaller than the height 538 of the wipe zone 530 at the left lateral seam line 514 and at the right lateral seam line 516. Alternately, the wipe zone 530 may comprise a uniform height throughout.

To effectively wipe away perspiration and moisture from the wearer, the wipe zone 530 may be comprised of a material made from yarns having a DPF between 0.025-0.0025 and may be hydrophobic, such as yarn 200 described with respect to FIGS. 2A-2B. Additionally, similar to the first and second wipe zones 134 and 144, respectively, of the garment 100, the wipe zone 530 is positioned and sized on garment 500 to be readily accessible to the wearer for wiping his or her palms in a generally downward or sideways motion, when needed, to easily and quickly remove perspiration.

Figure 7:
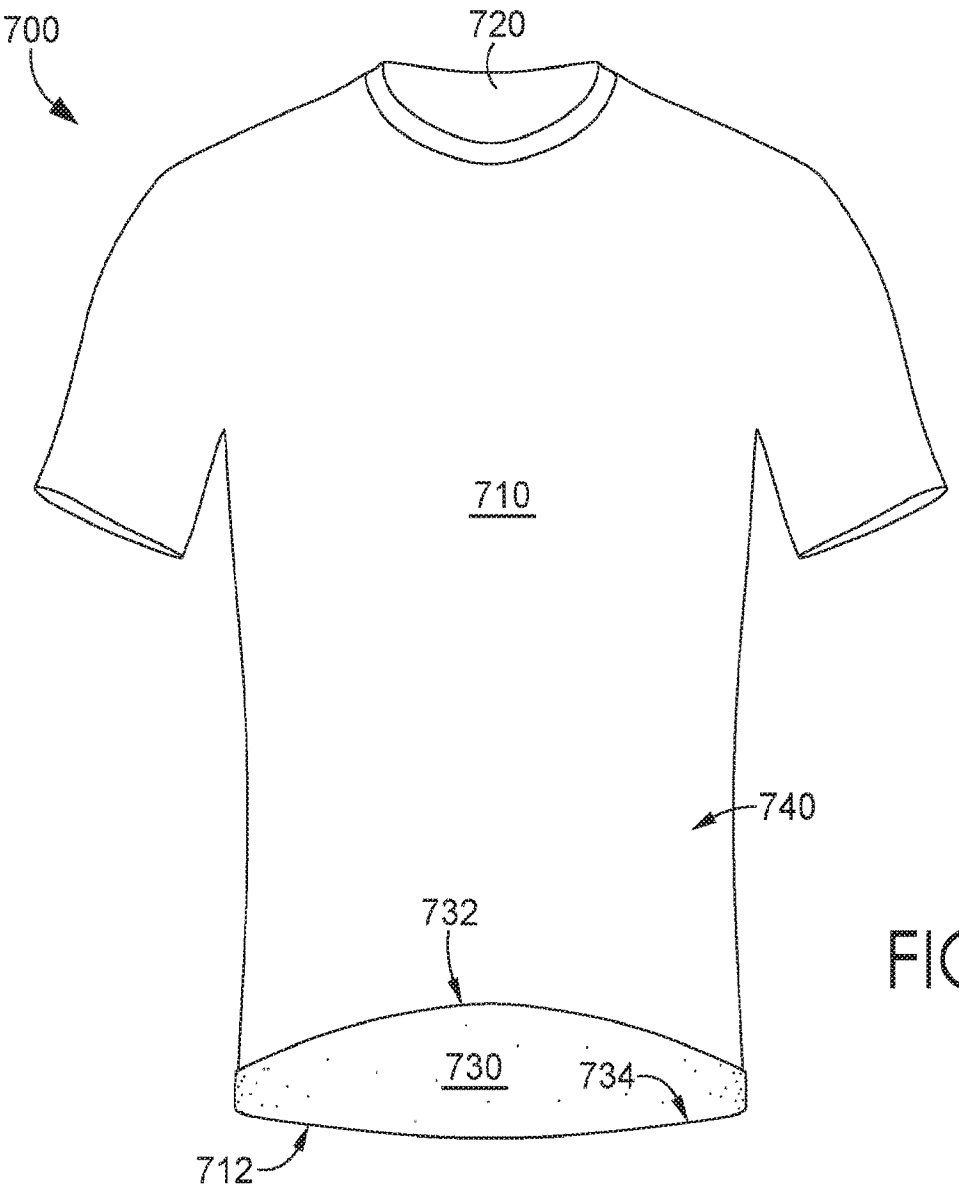
FIG. 7 depicts a front view of an exemplary upper-body garment having a wipe zone in accordance with aspects herein.

Although FIGS. 1-6 have illustrated exemplary lower-body garments having wipe zones, it is contemplated that upper-body garments may comprise similar wipe zones to use to wipe away perspiration and other moisture. FIG. 7 depicts an exemplary upper-body garment 700 having one or more wipe zones, in accordance with aspects herein. As previously mentioned, during physical activity, individuals often find the need and desire to remove perspiration, particularly from his or her face. Commonly, the individual will take the bottom front-facing portion of his or her upper-body garment, fold this portion up towards the individual's face, and use this bottom front-facing portion to wipe away the perspiration on his or her face.

Taking this motion into account, a garment 700 in accordance with aspects herein may be an upper-body garment with at least a front panel 710 and a back panel 720. The garment 700 may further include a non-wipe zone 740 being at least a portion of the front panel 710 and an adjacent wipe zone 730 at a bottom front portion of the garment 700. The non-wipe zone 740 may comprise a first material formed from yarns having a first DPF while the wipe zone 730 may comprise a second material formed from yarns having a second DPF that is within a range of 0.025 to 0.0025 such that the wipe zone 730 has a greater capacity to transfer away moisture from a wearer's skin upon contact compared to the non-wipe zone 740. The wipe zone 730 may form an outer-facing surface (exposed to the external environment) that is opposite from the skin-contacting surface of the garment 700. Additionally, the wipe zone 730 may extend from an upper edge 732 to a lower edge 734. As illustrated, the lower edge 734 of the wipe zone 730 may extend to the bottom edge 712 of the garment 700. Alternatively, the lower edge 734 of the wipe zone 730 may be at a distance from the bottom edge 712 of the garment 700. Positioning the wipe zone 730 to form an outer-facing surface of a front bottom portion of the garment 700 leverages the wearer's tendency to pull up the front bottom portion of an upper-body garment to wipe away moisture from the wearer's head or face.

The size and shape of the wipe zone 730 may be varied according to the functionality and aesthetic appeal desired for the particular garment 700. Although the garment 700 in FIG. 7 is depicted as a short sleeved crew neck t-shirt, it is contemplated herein that the upper-body garment 700 may be in the form of a V-neck sleeveless t-shirt, long-sleeved V-necked or crew necked t-shirt, a short or long sleeved hoodie, a short or long sleeved sweater, a thin, medium, or thick jacket, a tank top, a jersey tank top, and the like, without departing from aspects herein.

FIGS. 8 and 9 depict different views of a different exemplary upper-body garment 800 in the form of a jersey with portions removed to show wipe zones, in accordance with aspects herein. The upper-body garment 800 comprises a front panel 810 and a back panel 820 that together, define a neck opening 812. Accordingly, FIG. 8 provides a back view of the upper-body garment 800 with a portion of the back panel 812 cut away to show a wipe zone on an inner-facing surface of the front panel 810, while FIG. 9 provides a front view of the upper-body garment 800 with a portion of the front panel 810 cut away to show a wipe zone on an inner-facing surface of the back panel 812.

When perspiration drips into the face of a person, another motion to wipe away the perspiration is to take a front panel of an upper-body garment, pull the front panel over his/her face and wipe his/her face on an interior (skin-contacting) aspect of the front panel. As such, the upper-body garment 800, in accordance with aspects herein, comprises a non-wipe zone 840 and an adjacent wipe zone 830, wherein the wipe zone 830 is on an upper interior portion 814 (skin-contacting surface when worn) of the front panel 810 of the upper-body garment 800, as shown in FIG. 8.

The shape of the wipe zone 830 may generally correspond to the shape of the neck opening 812 and may cover a portion of the wearer's clavicle and/or upper chest when the garment 800 is worn. The wipe zone 830 may extend from an upper edge 832 to a lower edge 834. In some aspects, the upper edge 832 of the wipe zone 830 extends all the way to the neck opening 812. In other aspects, such as the one illustrated in FIGS. 8-9, the garment 800 includes a separate collar portion 818 extending continuously around an upper margin of the front panel 810 and back panel 820 to define the neck opening 812, and the upper edge 832 of the wipe zone 830 extends to and abuts the collar portion 818.

In some aspects, the upper-body garment 800 includes an additional or alternative wipe zone 850 on the upper back portion of the upper-body garment 800. The wipe zone 850 may be adjacent a non-wipe zone 860 on an upper interior portion 824 (skin-contacting surface when worn) of the back panel 820 of the upper-body garment 800 as shown in FIG. 9. The wipe zone 850 may extend from an upper edge 852 to a lower edge 852 with the upper edge 852 abutting a posterior portion of the collar portion 818. In other aspects, the wipe zone 850 may extend all the way towards an upper edge of the back panel 820 at the neck opening 812. Alternative aspects may include multiple wipe zones on the inside of the upper back portion of the garment covering the shoulder and/or back of the wearer. Additionally, in some aspects, the wipe zone 850 extends over the shoulder regions and is continuous with wipe zone 830 on the front panel 810.

As with the upper-body garment 700 of FIG. 7, the wipe zones 830 and 850 may comprise a material formed from yarns with a smaller DPF than the yarns of the material making up the non-wipe zone 840. In exemplary aspects, the DPF of the yarns forming the material of the wipe zones 830 and 850 is within a range of 0.025 to 0.0025 such that the wipe zones 830 and 850 have an increased capacity to wipe away perspiration on the wearer's skin, as discussed with respect to FIGS. 2A-2B. Accordingly, when a wear perspires on his or her face, head, or neck the wearer may pull up the top portion the garment 800 and wipe his or her face, head, or neck on the wipe zone 830 and/or the wipe zone 850 on the interior of the garment 800 to easily and quickly remove the perspiration. Additionally, utilizing wipe zones on the inside of the garment provides a wiping functionality with the natural shifting of the upper-body garment 800 on the wearer's body when the wearer is undergoing physical exertion.

Figure 10:
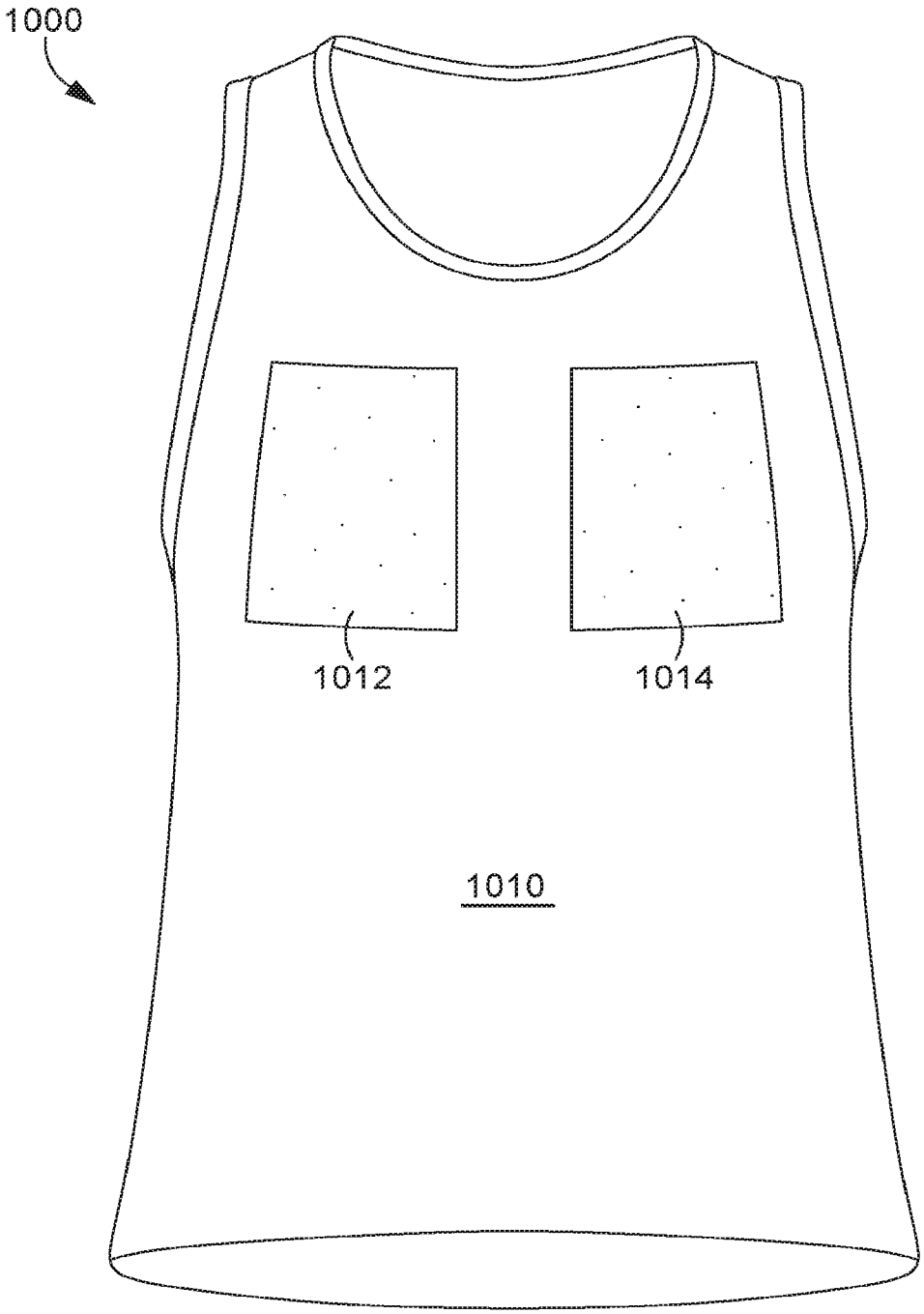
FIG. 10 depicts a front view of an exemplary upper-body garment having wipe zones in accordance with aspects herein.
Figure 11:
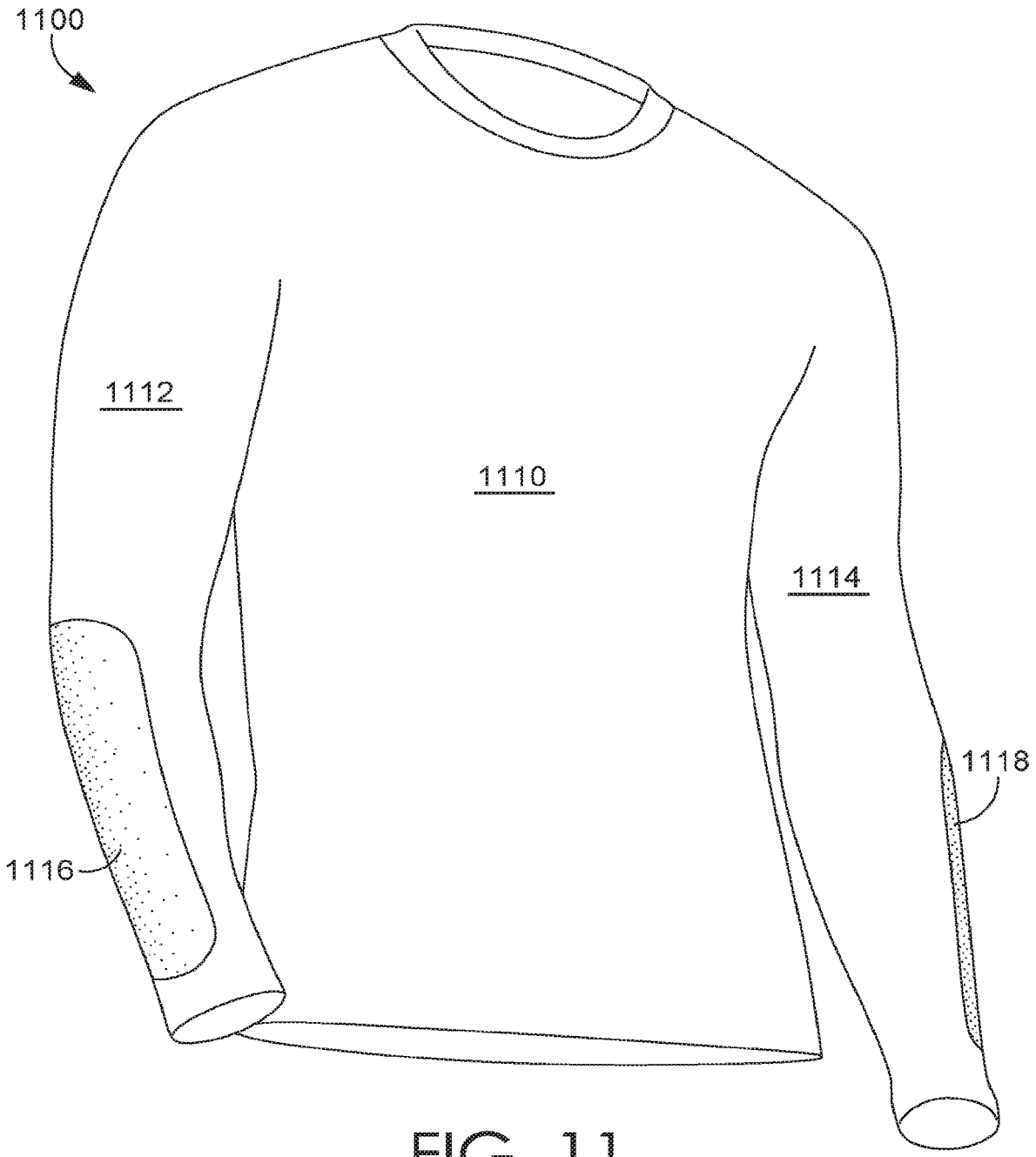
FIG. 11 depicts a front perspective view of an exemplary upper-body garment having wipe zones in accordance with aspects herein.
Figure 12:
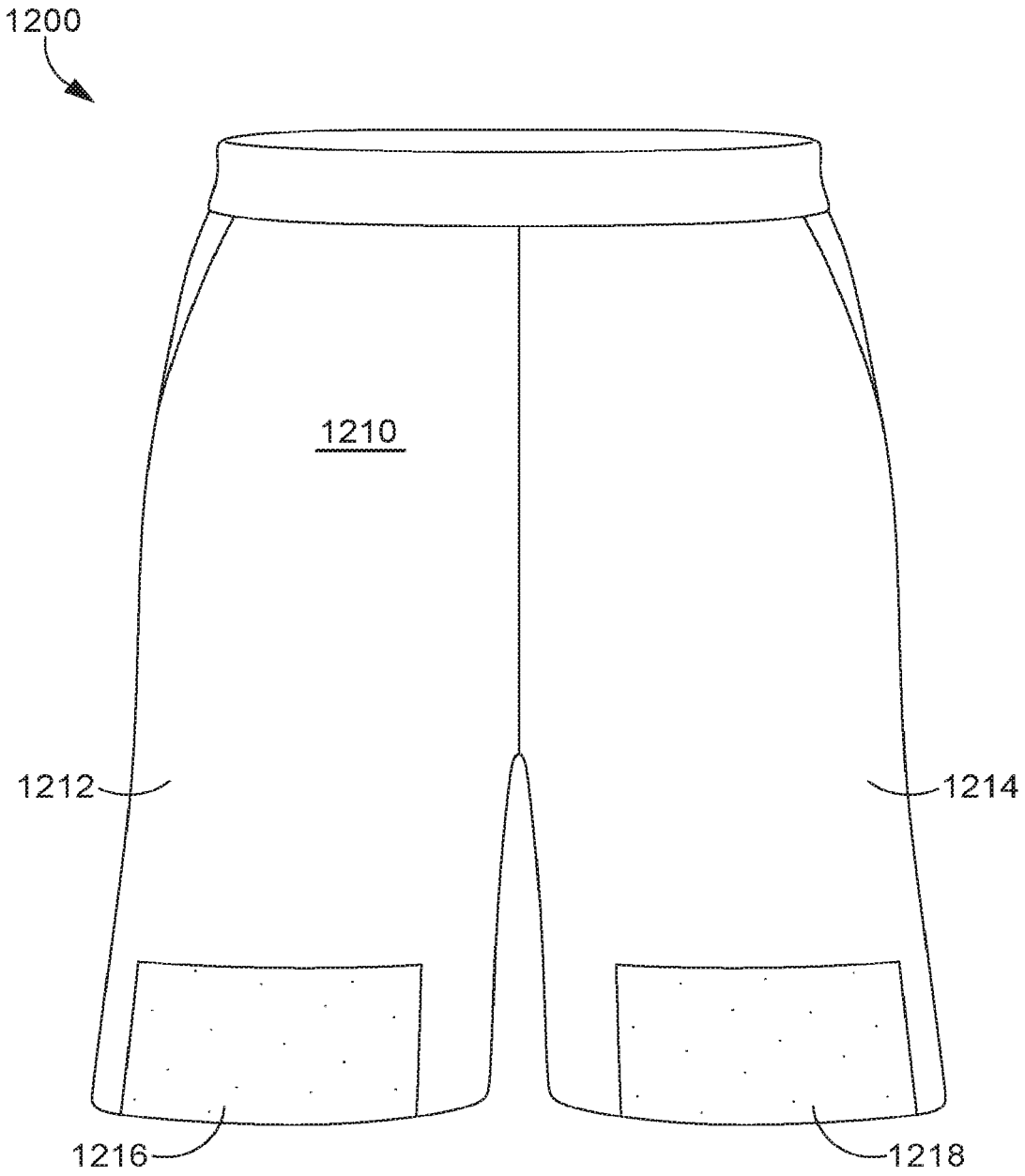
FIG. 12 depicts a front view of an exemplary lower-body garment having wipe zones in accordance with aspects herein.

Additional garments having wipe zones in other locations in accordance with aspects herein are illustrated in FIGS. 10-12. As shown in FIG. 10, an upper-body garment 1000 comprising a first wipe zone 1012 and a second wipe zone 1014 on a front panel 1010 of the upper-body garment 1000 is shown. The first and second wipe zones 1012 and 1014, respectively, may comprise a material formed from yarns with a smaller DPF than the yarns of the material making up other portions of the front panel 1010. The first wipe zone 1012 is located on an upper, right portion of the front panel 1010, and the second wipe zone 1014 is located on an upper, left portion of the front panel 1010. When the upper-body garment 1000 is worn, the first and second wipe zones 1012 and 1014, respectively, may be positioned to cover at least a portion of the wearer's chest and, more specifically, the wearer's pectoral area. Because a wearer may have a tendency to wipe his or her hands on the chest portion of his or her upper-body garment to remove perspiration, the positions of the first and second wipe zones 1012 and 1014, respectively, provide an easy and quick mechanism for removing perspiration and other moisture.

FIG. 11 depicts a long-sleeved upper-body garment 1100 having at least a front panel 1110, a right arm portion 1112, and a left arm portion 1114. The upper-body garment 1110 may have a first wipe zone 1116 on the right arm portion 1112 and a second wipe zone 1118 on the left arm portion 1114 with the first and second wipe zones 1116 and 118, respectively, comprising a material formed from yarn having a smaller DPF than yarns forming material for other portions of the upper-body garment 1100. The first wipe zone 1116 and the second wipe zone 1118 may extend over at least lateral portions of the wearer's right forearm and left forearm, respectively, when the upper-body garment 1100 is worn. The first and second wipe zones 1116 and 1118, respectively, may be used to remove perspiration from a wearer's forehead, taking advantage of the wearer's tendency to use the forearm to wipe away perspiration from the forehead.

FIG. 12 illustrates a lower-body garment 1200 comprising one or more front panels 1210 forming a right leg portion 1212 and a left leg portion 1214. The lower-body garment 1200 may include a first wipe zone 1216 and a second wipe zone 1218 that each comprises a material formed from yarn having a smaller DPF than yarns forming material for other portions of the lower-body garment 1200. The first wipe zone 1216 may be positioned on a front aspect of the right leg portion 1212 while the second wipe zone 1218 may be positioned on a front aspect of the left leg portion 1214. Specifically, the first and second wipe zones 1216 and 1218, respectively, may be positioned to cover at least inferior portions of the wearer's upper legs or quadriceps when the lower-body garment 1200 is being worn. In some aspects, the first and second wipe zones 1216 and 1218, respectively, may cover part or all of the wearer's knees. Accordingly, a wearer may remove perspiration from his or her hands by wiping his or her hands on the first and second wipe zones 1216 and 1218, respectively, at or near the wearer's knees. As illustrated in FIG. 12, the lower-body garment 1200 may be a pair of shorts, such as basketball shorts, and the first and second wipe zones 1216 and 1218, respectively, may extend to or almost extend to the inferior margin of the right and left leg portions 1212 and 1214, respectively. It is also contemplated that the lower-body garment 1200 may be a pair of pants or capris.

Figure 13:
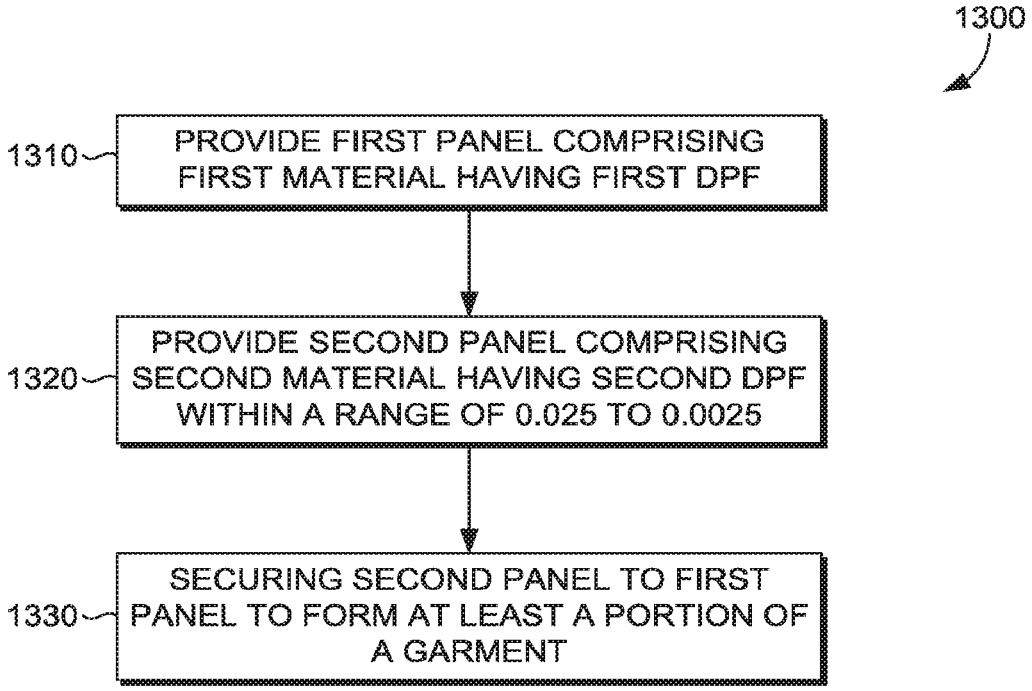
FIG. 13 depicts a flow diagram illustrating an exemplary method for manufacturing an exemplary garment having wipe zones in accordance with aspects herein.

Turning to FIG. 13, a flow diagram depicting a method 1300 of manufacturing a garment having one or more wipe zones in accordance with aspects herein is provided. The method 1300 includes, at step 1310, a first panel being provided, wherein the first panel comprises a first material formed from yarns having a first DPF. This first panel may comprise one or more non-wipe zones of a garment, such as the first and second non-wipe zones 136 and 146, respectively, of FIG. 1. Similarly, at step 1320, a second panel is provided, the second panel comprising a second material formed from yarns having a second DPF within a range of 0.025 to 0.0025. The second panel may comprise one or more wipe zones, such as the first and second wipe zones 134 and 144, respectively, of FIG. 1. As such, the second material of the second panel may be designed to effectively transfer fluids away from a person's skin upon contact, such as the material illustrated and discussed with respect to FIGS. 2A-2B. In aspects herein, the first panel and the second panel both comprise an outer-facing surface and an inner-facing surface. At step 1330, the second panel is secured to the first panel to form at least a portion of a garment.

As previously discussed with respect to FIGS. 3 and 4, the one or more wipe zones may be integrated into a garment as an overlay of or as an insert into a panel making up a non-wipe zone. As such, securing the first panel to the second panel at step 1330 may be performed in different ways. For instance, in one aspect, securing the first panel to the second panel includes securing at least a portion of the second panel to at least a portion of the outer-facing surface of the first panel such that the second panel overlays or is positioned adjacent to at least a portion of the outer-facing surface of the second panel. Securing the second panel to an outer-facing surface of the second panel may be used for manufacturing garments having wipe zones facing the external environment, such as the lower-body garments 100, 500, and 1200 of FIGS. 1, 5-6, and 12, respectively, and the upper-body garments 700, 1000, and 1100 of FIGS. 7, 10, and 11, respectively. In other aspects, securing the first panel to the second panel includes securing at least a portion of the second panel to at least a portion of the inner-facing surface of the first panel such that the second panel overlays or is positioned adjacent to at least a portion of the inner-facing surface of the first panel. In this way, the second panel making up the wipe zone may form an inner, skin-contacting surface of the garment, such as garment 800 of FIGS. 8-9.

In accordance with another aspect, the method 1300 includes, prior to securing the second panel to the first panel, removing a portion of the first panel to create an opening in the first panel, the opening being defined by a plurality of edges. Then, securing the second panel to the first panel may comprise securing portions or perimeter edges of the second panel to the first panel adjacent the plurality of edges. In this way, at least a majority of the second panel may be positioned between the plurality of edges defining the opening in the first panel. This method of integrating the wipe zones into the garments may be used to manufacture any of the garments discussed herein.

As previously mentioned, securing portions of the first panel to portions of the second panel may be done by permanently affixing the panels together by, for example, stitching, adhesives, bonding, and the like. In other aspects, the panels may be removeably affixed to one another by, for instance, buttons, zippers, snap closures, hook-and-loop fasteners, and the like.

In alternative aspects, the wipe zones may not be separate panels from other portions of the garment. Instead, the wipe zones may be manufactured by integrally interweaving or interknitting the yarns or fibers of the wipe-zone material, such as the second material formed from yarns with the second DPF within a range of 0.025 to 0.0025, into yarns or fibers of the non-wipe zone material, such as the first material. In accordance with these alternative aspects, the wipe zones may be seamlessly adjacent non-wipe zones within the garments.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This concept is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A garment comprising:

a first zone comprising a first material formed only from yarns having a first denier per filament (DPF); and a second zone positioned seamlessly adjacent the first zone, the second zone comprising a second material formed only from yarns having a second DPF that is less than the first DPF, wherein the second DPF is within a range of 0.025 to 0.0025, wherein the garment comprises an outer-facing surface and an inner-facing surface facing away from the outer-facing surface, the first zone and the second zone each comprise at least part of the outer-facing surface, such that the outer-facing surface comprises the yarns having the first DPF, and the yarns having the second DPF.

2. The garment of claim 1, wherein the second DPF of the yarns of the second material provides a greater surface area than the first DPF of the yarns of the first material for transferring fluid away from a wearer's skin upon contact with the wearer's skin.

3. The garment of claim 1, wherein the second material is hydrophobic.

4. A lower-body garment comprising:

a torso portion adapted to cover at least a lower torso area of a wearer when the lower-body garment is worn by the wearer;

a first leg portion extending from the torso portion; and a second leg portion extending from the torso portion, the torso portion, the first leg portion, and the second leg portion defining at least a waist opening, a first leg opening, and a second leg opening, wherein one or more portions of the lower-body garment include a wipe zone comprising a first material formed only from yarns having a first denier per filament (DPF) within a range of 0.025 to 0.0025, wherein the one or more portions of the lower-body garment include a non-wipe zone positioned seamlessly adjacent the wipe zone, the non-wipe zone comprising a second material formed only from yarns having a second DPF that is greater than the first DPF, wherein the lower-body garment comprises an outer-facing surface and an inner-facing surface facing away from the outer-facing surface, the wipe zone and the non-wipe zone each comprising at least part of the outer-facing surface.

5. The lower-body garment of claim 4, wherein the first leg portion and the second leg portion each include at least an anterior aspect and a posterior aspect and wherein the wipe zone forms a portion of the anterior aspect of the first leg portion and a portion of the anterior aspect of the second leg portion.

6. The lower-body garment of claim 4, wherein the torso portion includes at least an anterior aspect and a posterior aspect and wherein the wipe zone forms a portion of the posterior aspect of the torso portion.

7. The lower-body garment of claim 4, wherein the lower-body garment comprises a pocket adjacent a lateral seam line joining an anterior aspect and a posterior aspect of at least the first leg portion, the wipe zone being configured to extend to an opening of the pocket.

8. The lower-body garment of claim 4, wherein the torso portion comprises an upper margin, the wipe zone extending at least to an area proximate the upper margin.

* * * * *